United States Patent [19]

La Bate

[11] 4,239,602

[45] Dec. 16, 1980

[54] ASCENSION PIPE ELBOW LID FOR COKE OVENS

[75] Inventor: James B. La Bate, Beaver Falls, Pa.

[73] Assignee: Insul Company, Inc., East Palestine, Ohio

[21] Appl. No.: 59,909

[22] Filed: Jul. 23, 1979

[51] Int. Cl.[3] ..... C10B 27/00

[52] U.S. Cl. ..... 202/242; 202/256; 202/270; 138/92; 220/314; 220/256; 220/259

[58] Field of Search ..... 202/254, 255, 256, 261, 202/242, 246, 250, 259, 270; 138/92; 220/314, 256, 259

[56] References Cited

U.S. PATENT DOCUMENTS

| | | | |
|---|---|---|---|
| 168,121 | 9/1875 | Adee et al. | 138/92 |
| 2,105,248 | 1/1938 | Johnson | 220/259 |
| 4,083,468 | 4/1978 | Batchelor | 220/256 |
| 4,096,968 | 6/1978 | Treiber | 220/314 |

*Primary Examiner*—Norman Yudkoff

*Attorney, Agent, or Firm*—Webster B. Harpman

[57] ABSTRACT

An improved ascension pipe elbow lid for coke ovens forms a communication means between the coke oven and the volatile products collecting main. The improved structure incorporates a vent which is sealed to prevent the escape of pollutants into the atmosphere.

6 Claims, 4 Drawing Figures

ASCENSION PIPE ELBOW LID FOR COKE OVENS

BACKGROUND OF THE INVENTION (1) Field of the Invention

This invention relates to coke ovens for producing metallurgical coke from coal by coal carbonization and the collection of volatile products from the coke oven.

(2) Description of the Prior Art

Prior coke oven constructions have included the oven chambers in which the coal carbonization takes place, the chambers being normally closed by doors registering with jambs on the opposite ends of the oven. A collecting main communicates with the coke ovens for the recovery of the volatile products from the coal, connection being made by an ascension pipe elbow, which in the prior art was provided with a loosely fitting hinged lid registering with a vent opening in the bend of the elbow. The operating temperatures of the ascension pipe elbows in the prior art construction generally permitted excessive leakage of the volatile products continuously during the operation of the coke oven which comprises an undesirable air pollution source.

This invention provides an ascension pipe elbow with a vent and a lid structure that normally closes the vent and insures against the leakage of the volatile products therefrom so as to avoid air pollution.

SUMMARY OF THE INVENTION

An ascension pipe elbow for a coke oven has a vent opening and an improved closure therefor incorporating a baffle disposed within the elbow, a lid, and a refractory fiber disc gasket arranged in movable relation to one another and supported by a handle which in turn is pivoted to the exterior of the elbow.

DESCRIPTION OF THE PREFERRED EMBODIMENT

In the form of the invention chosen for illustration and description herein, the ascension pipe elbow comprises a pipe elbow 10 having an integral radially extending flange 11 on its lower horizontal end and a vertically positioned radially extending flange 12 on its vertical end. Fasteners 13 are provided to join the horizontal flange 11 to the coke oven as will be understood by those skilled in the art and fasteners 14 are provided to join the vertical flange 12 to the collecting main as will be understood by those skilled in the art.

Figure 1:
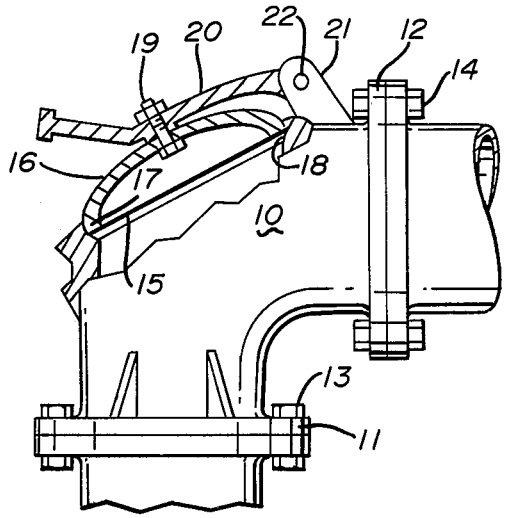
FIG. 1 PRIOR ART
FIG. 1 is a side elevation with parts broken away and parts in cross section illustrating the prior art ascension elbow construction.

The bend area of the elbow 10 has a circular opening 15 therein, the plane of the opening being disposed at an angle betwen horizontal and vertical and in FIG. 1 of the drawings, the representation of the prior art, the opening is shown closed by a dome-shaped circular lid 16. The peripheral edge 17 of the dome-shaped circular lid 16 engages against an annular shoulder 18 defining the circular opening in the bend area of the elbow 10.

The dome-shaped circular lid 16 is centrally apertured and a bolt 19 is positioned therethrough so as to extend through a registering opening in an apertured handle 20, one end of the apertured handle 20 is pivoted between a pair of brackets 21 on the elbow 10 by a pivot pin 22.

As will be understood by those skilled in the art, in the operation of a coke oven it is essential that the vent normally closed by the dome-shaped circular lid 16 be opened periodically and that between such openings it is desirable that it be closed so that the volatile products from the coke ovens will not escape to the atmosphere.

Figure 4:
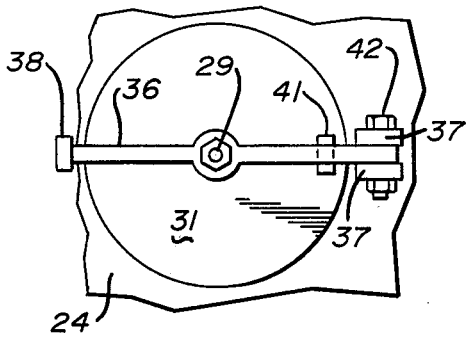
FIG. 4 is a top plan view on line 4—4 of FIG. 2.
Figure 2:
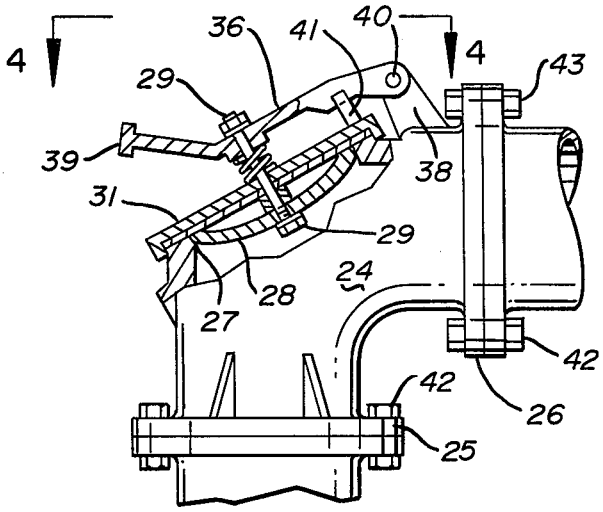
FIG. 2 is a side elevation with parts broken away and parts in cross section illustrating the improved sealing vent ascension pipe elbow.
Figure 3:
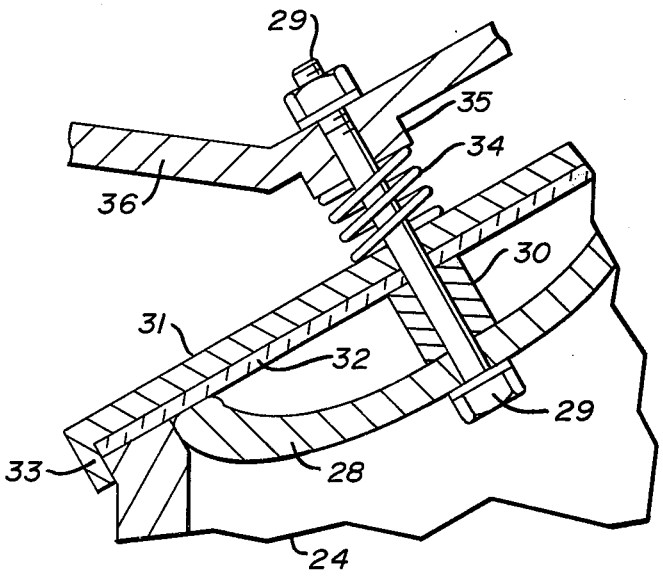
FIG. 3 is an enlarged detail of a portion of the sealing vent means of FIG. 2.

By referring now to FIGS. 2,3 and 4 of the drawings, the improvement comprising the present invention may be seen.

In FIG. 2 of the drawings the elbow is illustrated by the numeral 24, it has a horizontal flange 25 on its lower end and a vertical flange 26 on its upper side by means of which it communicates with the coke oven and the collecting main respectively as will be understood by those skilled in the art. The elbow 24 has a vent in the bend area, the vent comprising a circular opening defined by an annular shoulder 27. An inverted dome-shaped circular baffle 28 is positioned within the area defined by the annular shoulder 27 and so as to be movable outwardly of the opening. The baffle 28 is centrally apertured and a bolt 29 is positioned through the aperture and extends outwardly. A tubular spacer 30 is positioned on the baffle 28 and serves to space the baffle 28 with respect to a circular lid 31, which is also centrally apertued and through which the bolt 29 extends. A gasket 32 formed of refractory fibers and treated with a liquid graphite suspension forming a desirable parting agent is preferably disc-shaped and is positioned within the area of the lid 31 as defined by an annular flange 33 thereof. The gasket 32 is centrally apertured and the bolt 29 passes therethrough. A coil spring 34 is positioned about the bolt 29 and on the opposite side of the circular lid 31 with respect to the gasket 32 and is engaged against a boss 35 on a handle 36, both of which are apertured and through which the bolt 29 passes. A nut 37 tensions the assembly desirably as will be understood by those skilled in the art.

The bolt 29, baffle 28, spacer 30, gasket 32, lid 31, spring 34 and the handle 36 are best illustrated in enlarged detail of FIG. 3 of the drawings.

By referring again to FIGS. 2 and 4 of the drawings, it will be seen that the handle 36 extends in one direction from the boss 35 and the bolt 29 to a pair of apertured brackets 38 and in the opposite direction to a T-shaped end 39 which completes the configuration of the handle 36. The handle 36 is pivoted between the brackets 38 by a pivot pin 40 and still referring to FIGS. 2 and 4 of the drawings, it will be seen that there is a secondary notched bracket 41 on the lid 31, the notch being of a configuration that will receive the portion of the handle 36 presented thereto and thus prevent rotation of the circular lid 31 relative to the handle 36 and/or the annular shoulder 27 defining the vent opening in the elbow 24.

When the device is installed between a coke oven and a collecting main as seen for example in FIG. 2 of the drawings, fasteners 42 are positioned through openings in the horizontal flange 25 of the elbow 24 to secure the device to the coke oven and fasteners 43 are positioned through the vertical flange 26 of the elbow 24 to secure the same to the collecting main for the volatile products.

It will thus be seen that the device of the invention while resembling the prior art, incorporates structure which functions to prevent the accidental leakage of volatile products from the ascension elbow as has heretofore been the case and at the same time permit a vent in the ascension elbow to be opened periodically as necessary in the coke oven operation.

The novel structure includes the positioning of the dome-shaped circular baffle 28 in the area of the bend of the elbow 24 where it deflects the hot volatile gasses that flow through the same.

Those skilled in the art will observe that the gas and vapors ordinarily leave a coke oven at temperatures in the range of 1100° to 2100° F. and the present structure deflects these high temperature gasses from the circular lid 31 to insure its shape retention and sealing ability. Most importantly the disc-shaped gasket 32 of refractory fibers treated with a liquid suspension of graphite forms a parting agent permitting the opening of the lid when desired and provides an effective gas and volatile products seal when the lid is closed. Additionally it forms an effective insulation means protecting the circular lid 31.

Experiments with the device of the invention installed on a multichambered coke oven installation demonstrated the effectiveness of the invention in preventing the pollution of the atmosphere by the complete control of the volatile products at all times the vent structure was closed. The device also prevents the build up of tar and other solids in the elbow.

Those skilled in the art will observe that the present invention may be economically and rapidly installed on existing coke oven installation to effect air quality control as many of the original parts of the ascension elbow, the dome-shaped circular lid, handle, etc. can be reworked to include the addition of the circular lid 31, the gasket 32, the spacer 30, the tensioning spring 34 and the repositioning of the original circular lid 16 as a dome-shaped circular baffle in a new and important structural and functional relation in the ascension elbow.

Although but one embodiment of the present invention has been illustrated and described, it will be apparent to those skilled in the art that various changes and modifications may be made therein without departing from the spirit of the invention and having thus described my invention what I claim is:

1. An improved ascension pipe elbow for coke ovens wherein the elbow has an angularly disposed circular shoulder in an upper portion thereof defining a vent opening in said elbow, the improvement consisting of a lid, means on the elbow hinging the lid thereto for arcuate movement toward and away from said vent opening, an inverted dome-shaped circular baffle and means attaching said baffle to said lid, said baffle positioned for location through said vent opening and substantially within said ascension elbow when said lid is closed, an insulating gasket of refractory fibrous material positioned between said lid and said inverted dome-shaped baffle with the peripheral edge of said gasket normally engaged between said lid and said circular shoulder on the ascension elbow surrounding the vent opening therein so as to normally seal the same.

2. The improved ascension pipe elbow set forth in claim 1 and wherein said lid is circular and has an annular depending flange on its peripheral edge and the insulating gasket is positioned within said annular depending flange.

3. The improved ascension pipe elbow set forth in claim 1 and wherein said insulating gasket is treated with a liquid graphite suspension.

4. The improved ascension pipe elbow set forth in claim 1 and wherein the means on the elbow hinging the lid thereto is arranged to permit relative movement between said circular baffle and said lid and is spring tensioned.

5. The improved ascension pipe elbow set forth in claim 1 and wherein the means on the elbow hinging the lid thereto comprises an elongated handle, brackets on said elbow adjacent said circular shoulder, a pivot member at one end of said elongated handle engaging openings in said brackets, a compression spring positioned between said handle and lid, a tubular spacer positioned between said lid and said inverted dome-shaped baffle and a bolt positioned through said dome-shaped baffle, the gasket, the tubular spacer, the lid, the spring and the elongated handle for adjustably securing said means to one another.

6. The improved ascension pipe elbow set forth in claim 5 and wherein a notched boss is positioned on said lid for reception of a portion of said elongated handle in said notch so as to prevent said lid from rotating relative to said handle.

* * * * *